United States Patent [19]

Bourque et al.

[11] 4,282,659

[45] Aug. 11, 1981

[54] SPORTS BOOT STRAP CLOSURE SYSTEM

[75] Inventors: Rene Bourque, Duvernay; Lorne S. Overbaugn, Burlington, both of Canada

[73] Assignee: Gamebridge, Inc., Quebec, Canada

[21] Appl. No.: 68,400

[22] Filed: Aug. 21, 1979

[51] Int. Cl.[3] ..... A43B 5/00; A43B 11/00

[52] U.S. Cl. ..... 36/121; 36/50

[58] Field of Search ..... 36/117, 118, 119, 120, 36/121, 50

[56] References Cited

U.S. PATENT DOCUMENTS

| | | | |
|---|---|---|---|
| 2,285,993 | 6/1942 | Marsh et al. | 36/50 |
| 3,793,749 | 2/1974 | Gertsch et al. | 36/121 |
| 4,130,949 | 12/1978 | Seidel | 36/50 |
| 4,142,307 | 3/1979 | Martin | 36/50 |

*Primary Examiner*—Patrick D. Lawson

*Attorney, Agent, or Firm*—Schwartz, Jeffery, Schwaab, Mack, Blumenthal & Koch

[57] ABSTRACT

A closure system is provided for a front entry ice skate sports boot having a top, an ankle portion with a back, a front opening, and sides extending above the ankle bone of a wearer, and an upper with a front opening. A plurality of guide means are disposed on the upper on opposite sides of the front opening for receiving and guiding a substantially flat flexible strap. The guide means are constructed such that the strap can be laced through the guide means in such a direction that the ends of said strap are generally near the top of the boot, and substantially encircle the ankle portion above the ankle bone. A hinge movably attaches the ankle portion to the upper for limited rotation therebetween. A plurality of guide means are also disposed on the ankle portion on opposite sides of the front opening. Fastening means are positioned on the strap and include a strap adjusting part through which the strap passes. The strap adjusting part releasably retains the strap in a fixed relationship with the fastening means. A hook for attaching the strap to the boot may be located on the ankle portion.

12 Claims, 7 Drawing Figures

SPORTS BOOT STRAP CLOSURE SYSTEM

BACKGROUND OF THE INVENTION

The present invention relates generally to boots such as ski boots and ice skates and is more specifically directed to a novel strap closure system which replaces the conventional laces in front-entry boots.

A front-entry boot is a boot of the type having a front opening extending from near the toe of the boot of the front of the boot to the top thereof. Such front-entry boots are traditionally closed by the use of laces. One of the difficulties with this type of closure system is that the laces tend to "bind-up" where they pass through the eyelets arranged on either side of the front opening. This necessitates a tedious process of systematically tightening the boot by applying tension to the laces at several different points begining at the toe of the shoe and progressing upwards until the boot is tightly and uniformly closed.

In addition, where laces cross over the front opening, they tend to create "pressure points" which are uncomfortable to the wearer of the boot. Another drawback of the lacing system is that the boot in which such a system is used does not flex evenly when in use as a result of the fact that the laces do not freely slide past one another and through the eyelets when stress is applied to the boot. Still another disadvantage of the prior art is the difficulty the user experiences in attempting to tighten the boot consistently for successive uses.

SUMMARY OF THE INVENTION

It is therefore an object of the present invention to provide a closure system for a boot which overcomes the limitations of the prior art by eliminating the conventional laces in such a boot.

It is also an object of the present invention to provide a closure system for a boot having a preadjustment feature, allowing a user to quickly and consistently tighten and release the closure system without the necessity of adjusting the tension.

Other objects and benefits of the present invention will become apparent from the following disclosure.

In accomplishing the foregoing objects, there has been provided in accordance with the present invention an improved closure system for a boot, comprising a substantially flat flexible strap which replaces the conventional lace, which is "laced" through a series of guides arranged on the upper of the boot. After passing through the guides, the strap is passed across the side of the boot above the wearer's ankle bone. Thereafter the strap either encircles the ankle of the wearer, or is attached to a hook on the side of the boot above the ankle bone of the wearer and returned to the front of the boot. The strap ends are then fastened in the front of the boot and held securely.

BRIEF DESCRIPTION OF THE DRAWINGS

The above and other objects of the invention will be appreciated from the following description and accompanying drawings, wherein.

DETAILED DESCRIPTION OF THE PREFERRED EMBODIMENT

Figure 1:
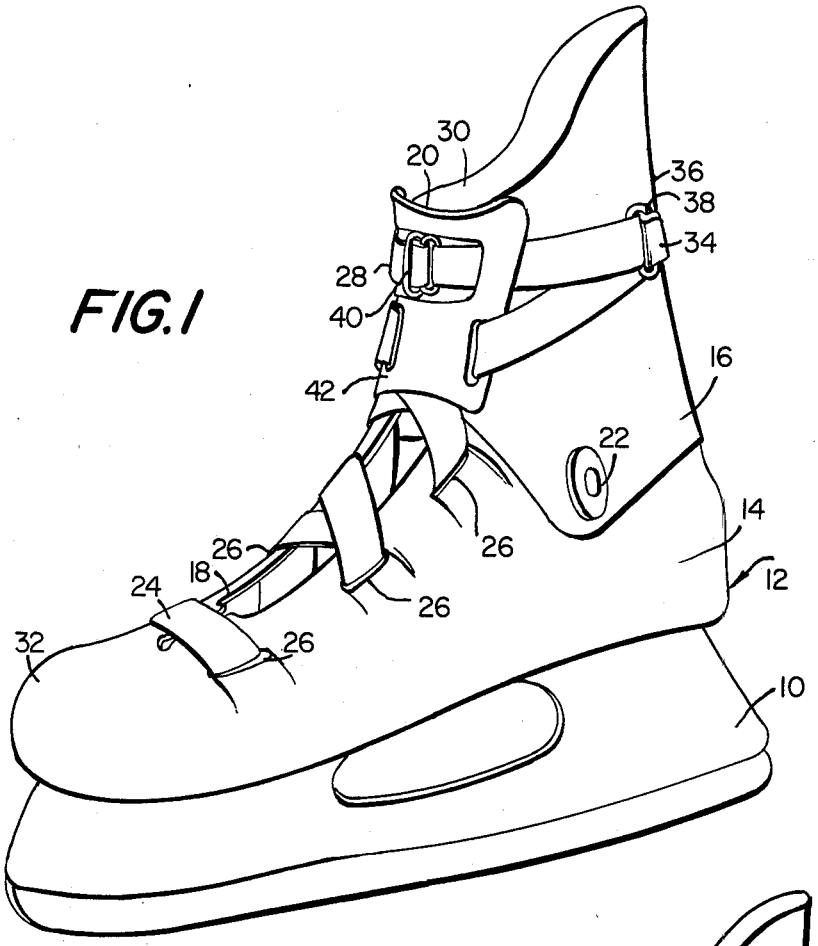
FIG. 1 is a perspective view of one embodiment of the invention incorporated in an ice skate boot.

Referring now to the drawings, FIG. 1 shows an ice skate boot incorporating the present invention, having a blade 10 attached to a boot 12. The boot 12 comprises an upper 14 and an ankle portion 16, both of which are made of leather, poromeric material, or other synthetic materials. Incorporated in both the upper 14 and the ankle portion 16 are front openings 18 and 20. A hinge means 22, which may consist of a pin passing through both the upper 14 and the ankle portion 16 attaches the ankle portion 16 to the upper 14, allowing limited rotation between these two parts.

The closure system of the invention incorporates a flat, flexible strap 24, which may be made of nylon or other suitable material. The strap 24 is laced through a plurality of guides 26 located on both sides of the front openings 18 and 20. The lacing is done in a conventional manner by crossing and recrossing the straps 24 across the openings 18 and 20, and alternately passing the strap 24 through and reversing the direction thereof at the guide means 26. The lacing progresses in such a manner that a pair of ends 28 of the strap 24 are closer to the top 30 of the shoe than they are to the toe 32 of the shoe.

The ankle portion 16 is of such a height that it will extend above the ankle bone of a wearer. The ankle portion 16 is provided with a hook means 34 on the side thereof near the a 36. An attaching means 38 is provided on the strap 24, attaching the strap 24 to the hook means 34. The attaching means 38 is made of a loop of metal or other suitable material through which the strap 24 can slide. The strap 24 is fastened by a fastening means 40 over the front opening 20 of the ankle portion 16. The fastening means 40 is affixed near the ends 28 of the strap 24. The strap 24 also passes through and retains a protective plate 42 over the front opening 20 of the ankle portion 16.

Figure 2:
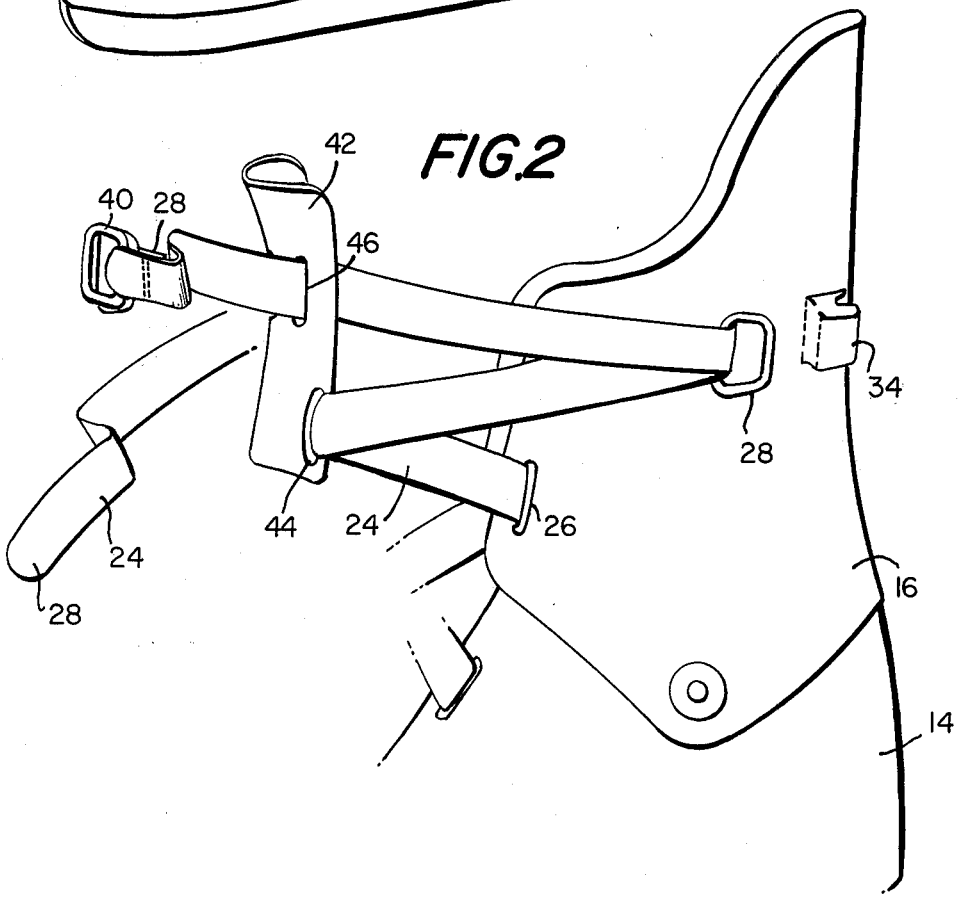
FIG. 2 is a detailed, opened view of the fastening system shown in FIG. 1.

The operation of the embodiment of the invention shown in FIG. 1 is illustrated in FIG. 2. The strap 24 passes through the guide means 26, which are preferably elongated apertures in the upper 14 and the ankle portion 16 as shown, or may be loops of metal or other suitable structures on the upper 14 and the ankle portion 16 through which the strap 24 can freely slide. After passing through the guide means 26 on the ankle portion 16, the strap 24 passes through an aperture 44 on the plate 42, through the attaching means 38, through another aperture 46 on the plate 42, and then is securely fastened to the fastening means 40, which can comprise a double loop buckle of the type shown, or other fastening means suitable for allowing a strap passing therethrough to be tightened, but preventing retrograde motion of the strap after tightening has occurred.

To close the shoe 12 one attaches the attaching means 38 to the hook means 34, passes the strap 24 through the fastening means 40, and applies tension to the end 28 of the strap 24. The strap 24 will slide through the guide means 26, the apertures 44 and 46, and the attaching means 38, drawing the strap 24 tightly along the side of the ankle portion 16, pulling the plate 42 tightly against the front opening 20, and closing the front openings 18 and 20. The shoe so closed is now ready for use by the wearer.

To open and remove the shoe, the user loosens the strap 24 slightly through the fastening means 40, removes the attaching means 38 from the hook means 34, spreads the openings 18 and 20, and removes the shoe. Much less time is consumed by using this novel closure system than is used in a conventional system employing conventional laces. Also, a more even tension is applied by the strap 24 to close the front openings 18 and 20 than is possible with conventional laces, as the guide means 26 allow the strap 24 to slide freely therethrough, and the strap 24 does not "bind-up" at the points in which it crosses itself, because of the large surface area in contact at such points, and the resulting lack of any "pressure points". Also, where the strap 24 crosses over the openings 18 and 20, it offers much more protection to the wearer's foot than do conventional laces. Additionally, the portion of the strap 24 passing across the ankle portion 16 to the attaching means 38 and returning to the fastening means 40 tends to lend substantial support to the ankle of a wearer.

Figure 2A:
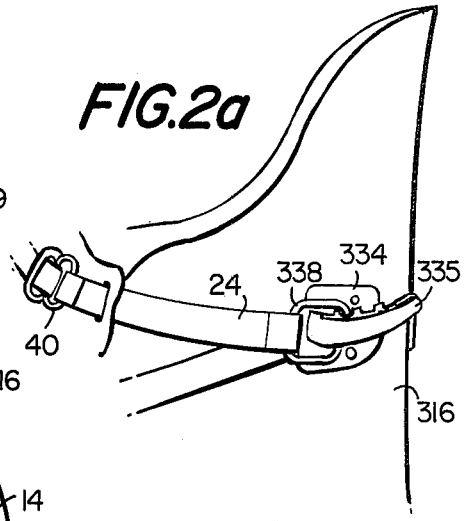
FIG. 2(a) a view of a variation of FIGS. 1 and 2.

The closure system shown in FIGS. 1 and 2 may be modified to incorporate a preadjustment feature as illustrated in FIG. 2(a). This may be done by providing a hook means 338 which is a lever-type buckle 335 of the kind commonly used in closing ski boots. In this embodiment, the relative relationship of the strap 24 to the fastening means 40 would remain unchanged while the closure system is loosened by releasing the lever-type buckle 335, or tightened by attaching the lever-type buckle 335 to the attaching means 334.

Alternatively, if the fastening means 40 comprises a two-part separable clasp, the boot may be removed by separating the clasp, and may be quickly and consistently tightened by joining the two pieces of the separable clasp.

Figure 3:
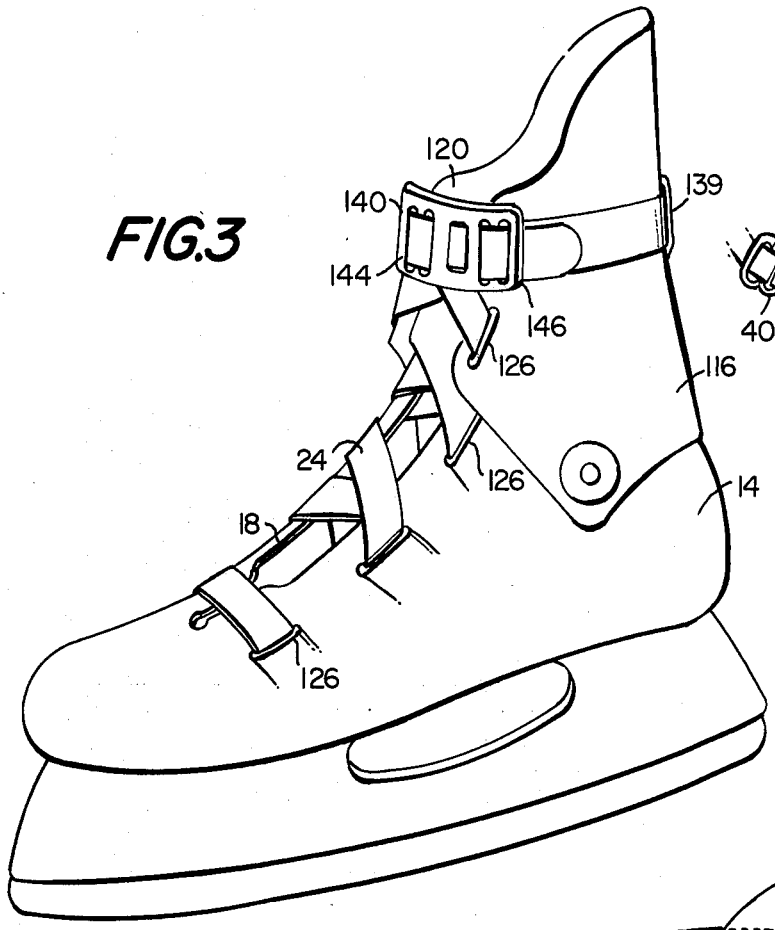
FIG. 3 illustrates another embodiment of the invention incorporated in an ice skate boot.

Another embodiment of the invention is illustrated in FIG. 3. Where the numbers are the same as those shown in FIGS. 1 and 2, they refer to identical parts. The upper 14 and the ankle portion 116 are provided with guide means 126 through which the strap means 24 is laced. After passing through the guide means 126, the strap 24 encircles the ankle portion 116 above the ankle bone of the wearer, passing through loop means 139. The fastening means 140 comprises a separable clasp with two parts 144 and 146.

Figure 4:
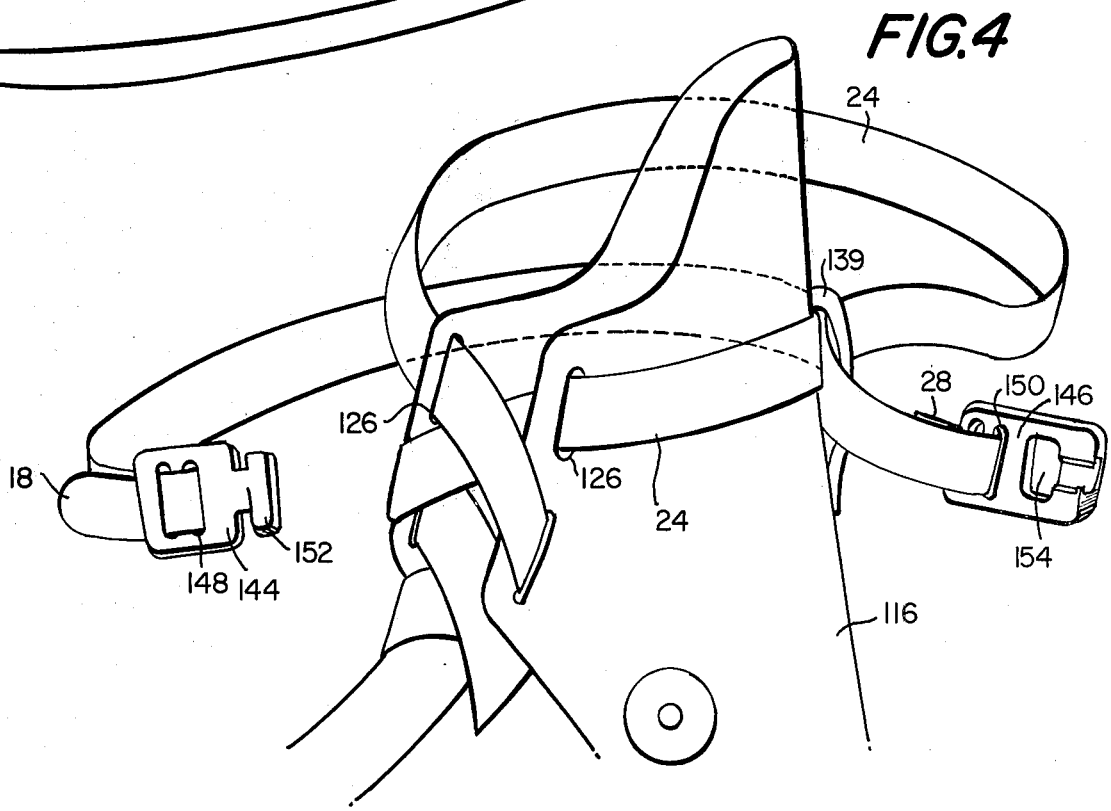
FIG. 4 is a detailed, opened view of the closure system shown in FIG. 3.

The operation of the closure system shown in FIG. 3 is illustrated in FIG. 4. After passing through the guide means 126, the strap 24 passes about and encircles the ankle portion 116, and is retained at the back of the ankle portion 116 by the loop means 139. The parts of the separable clasp 144 and 146 include strap adjusting means 148 and 150. The strap adjusting means 148 and 150 frictionally retain the strap in a fixed relationship with the two parts 144 and 146.

To close the shoe, a tab 152 on the part 144 is inserted into a slot 154 on the part 146. Of course, the tab and slot two part separable clasp 140 shown in FIG. 3 may be replaced by any conventional two part separable clasp.

Figure 5:
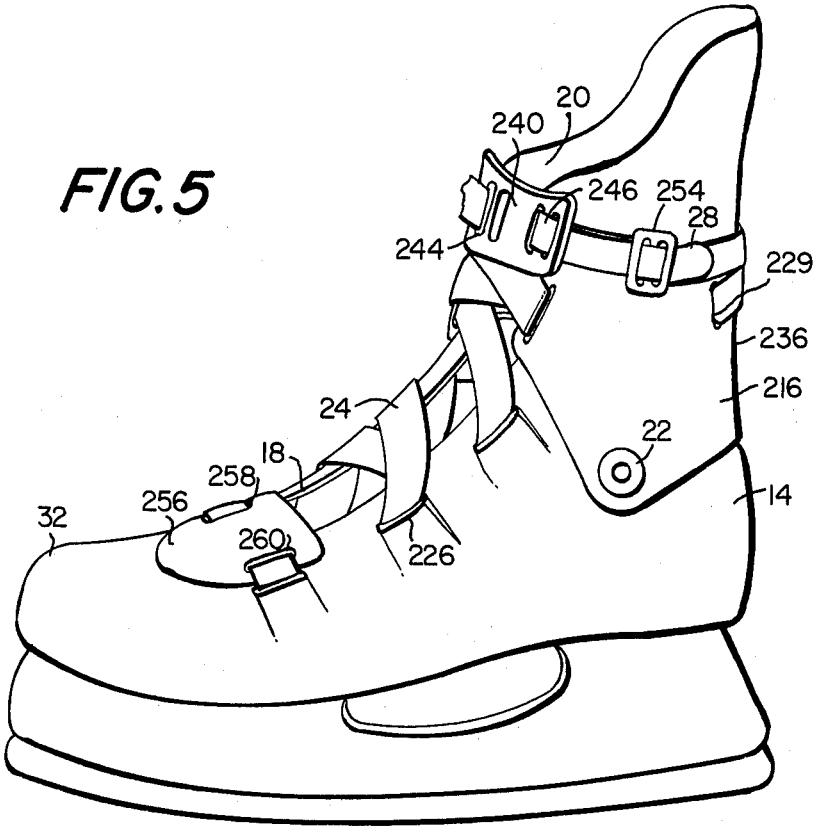
FIG. 5 shows still another embodiment of the invention incorporated in an ice skate boot.

FIG. 5 shows still another embodiment of the invention. Figures identical with those shown in the other drawings represent identical parts.

In this embodiment, the strap 24 is laced through guide means 226 on the upper 14 and the ankle portion 216. The strap 24 passes across the ankle of the wearer inside the ankle portion, out through apertures 229 near the back 236 of the ankle portion 216, encircles the ankle portion 216, is frictionally fastened to fastening means 240 through strap adjusting means 244 and 246. The end 28 of the strap 24 is retained by retaining means 254 located on the side of the ankle portion 216. Also provided is toe plate 256, with apertures 258 and 260 through which the strap 24 is laced near the toe 32 of the boot.

Figure 6:
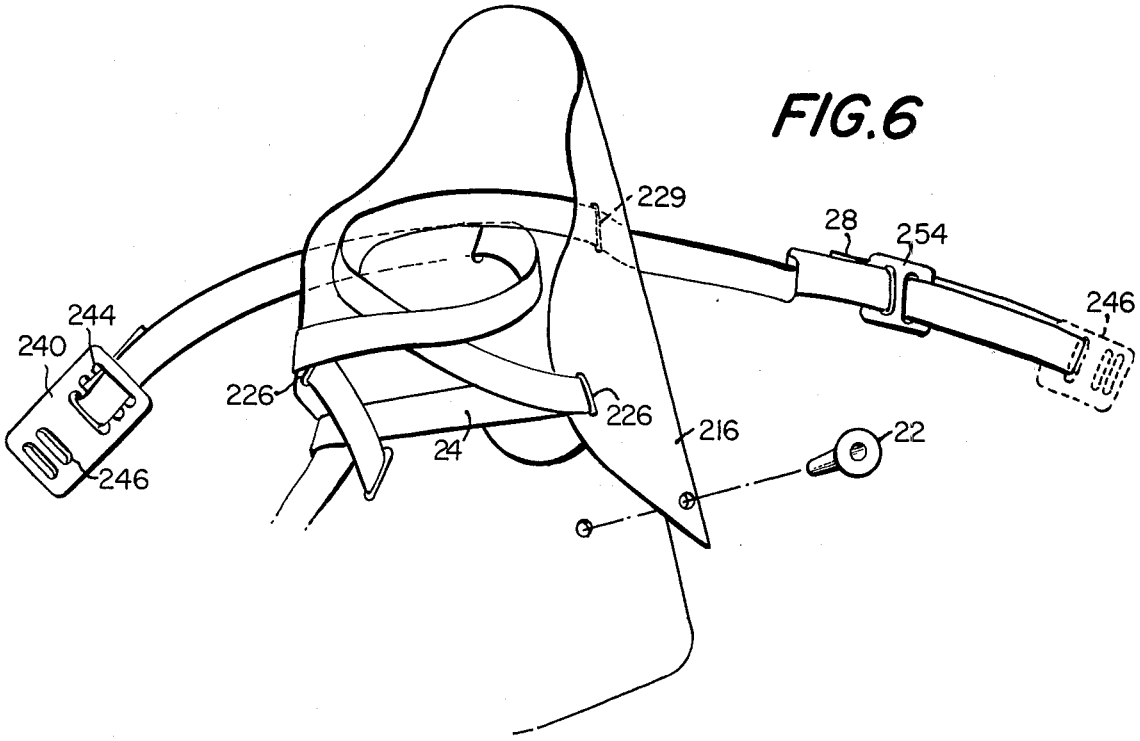
FIG. 6 is a detailed, opened view of the closure system shown in FIG. 5.

FIG. 6 shows the operation of the closure system shown in FIG. 5. The strap 24 passes through the guide means 226 on the ankle portion 216, encircles the ankle of the wearer inside the ankle portion 216, and passes to the outside of the ankle portion through apertures 229. The strap is then threaded through the strap adjusting parts 244 and 246 of fastening means 240. The end 28 of the strap 24 is held by retaining means 254. The boot may be tightened by applying tension to the end 28 of the strap 24.

The embodiments shown in FIGS. 3 and 5 lend support to the wearer's ankle by passing thereabout. In addition, when the design is used in combination with a hockey skate boot, it eliminates the need for the wearer to tape his pads in place. The pads are held securely by the strap about the ankle.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A closure system for a front entry boot having a top, an ankle portion with a back, a front opening, and sides extending above the ankle bone of a wearer, and an upper with a front opening, comprising:

(a) a substantially flat flexible strap having two ends;

(b) a plurality of guide means on the upper disposed on opposite sides of the front opening for receiving and guiding said strap, said guide means constructed such that said strap can move therethrough, said strap being laced through said guide means in such a direction that the ends of said strap are generally near said top of the boot;

(c) a hook means on the side of the ankle portion;

(d) fastening means on said strap, said fastening means including a strap adjusting part through which said strap passes, said strap adjusting part releasably retaining said strap in a fixed relationship with said fastening means;

(e) attaching means on said strap between said guide means and said fastening means, said attaching means releasably attaching said strap to said hook means, a length of said strap passing across said ankle portion, and passing through and reversing at said attaching means, said strap arranged such that tension applied to said strap at either said fastening means or said attaching means will tend to close said front openings and tighten said length of said strap across said ankle portion.

2. A closure system as defined by claim 1, wherein said fastening means comprises a two part separable clasp, the two parts of said separable clasp each being attached to said strap near the ends thereof, one part of said separable clasp including said strap adjusting part, said strap adjusting part holding said strap in such a relationship thereto that the joining of said two parts of said separable clasp tightens said length of strap across said ankle portion and tends to close said front openings.

3. A closure system as defined by claim 1, wherein said hook means comprises a lever type buckle means which applies tension to said strap when said buckle is attached to said attaching means.

4. A closure system for a front entry boot having a top, an ankle portion with a back, a front opening, and sides extending above the ankle bone of a wearer, and an upper with a front opening, comprising:

(a) a substantially flat flexible strap having two ends;

(b) a plurality of guide means on the upper disposed on opposite sides of the front opening for receiving and guiding said strap, said guide means constructed such that said strap can move therethrough, said strap being laced through said guide means in such a direction that the ends of said strap are generally near the top of the boot, said strap substantially encircling said ankle portion above the ankle bone;

(c) fastening means on said strap, said fastening means including a strap adjusting part through which said strap passes, said strap adjusting part releasably retaining said strap in a fixed relationship with said fastening means, said strap arranged such that tension applied to said strap at said fastening means will tend to close said front openings and tighten said length of said strap around said ankle portion.

5. A closure system as defined by claim 1 or 4, further comprising hinge means movably attaching said ankle portion to said upper for limited relative rotation therebetween.

6. A closure system as defined by claim 1 or 4, wherein said boot is a sports boot.

7. A closure system as defined by claim 6, wherein said sports boot is an ice skate boot.

8. A closure system as defined by claim 1 or 4, further comprising a plurality of said guide means on said ankle portion disposed on opposite sides of said front opening.

9. A closure system as defined by claim 4, further comprising loop means disposed on the back of said ankle portion, said strap passing through said loop means.

10. A closure system as defined by claim 4, further comprising an aperture in the back of said ankle portion, said strap passing through said aperture as it encircles said ankle portion.

11. A closure system as defined by claim 4 wherein said fastening means comprises a two part separable clasp, the two parts of said separable clasp each being attached to said strap near the ends thereof, one part of said separable clasp including said strap adjusting part, said strap adjusting part holding said strap in such a relationship thereto that the joining of said two parts of said separable clasp tightens said strap around said ankle portion and tends to close said front openings.

12. A closure system for a front entry ice skate sports boot having a top, an ankle portion with a back, a front opening, and sides extending above the ankle bone of a wearer, and an upper with a front opening, comprising:

(a) a substantially flat flexible strap having two ends;

(b) a plurality of guide means on the upper disposed on opposite sides of the front opening for receiving and guiding said strap, said guide means constructed such that said strap can move therethrough, said strap being laced through said guide means in such a direction that the ends of said strap are generally near the top of the boot, said strap substantially encircling said ankle portion above the ankle bone;

(c) hinge means movably attaching said ankle portion to said upper for limited relative rotation therebetween;

(d) a plurality of said guide means on said ankle portion disposed on opposite sides of said front opening;

(e) fastening means on said strap, said fastening means including a strap adjusting part through which said strap passes, said strap adjusting part releasably retaining said strap in a fixed relationship with said fastening means.

* * * * *